US005490579A

United States Patent [19]

Ratcliffe et al.

[11] Patent Number: 5,490,579

[45] Date of Patent: Feb. 13, 1996

[54] TANKER ACCESS PLATFORM

[75] Inventors: Ralph D. Ratcliffe, Oakville; Roelof Van Der Sleen, Mississauga, both of Canada

[73] Assignee: Preventative Maintenance Systems, Oakville, Canada

[21] Appl. No.: 258,861

[22] Filed: Jun. 10, 1994

[51] Int. Cl.[6] ..... B66B 11/08

[52] U.S. Cl. ..... 187/266; 187/263; 187/254

[58] Field of Search ..... 187/254, 251, 187/250, 266, 263

[56] References Cited

U.S. PATENT DOCUMENTS

| | | | |
|---|---|---|---|
| 595,874 | 12/1897 | Duwelius | 187/266 |
| 3,101,130 | 8/1963 | Bianca | 187/266 X |
| 3,838,752 | 10/1974 | Berkovitz | 187/266 |
| 5,025,893 | 6/1991 | Saito | 187/266 |
| 5,370,205 | 12/1994 | Vanhala | 187/266 X |

FOREIGN PATENT DOCUMENTS

| | | | |
|---|---|---|---|
| 578237A1 | 1/1994 | European Pat. Off. | 187/266 X |
| 6135659 | 5/1994 | Japan | 187/254 X |

*Primary Examiner*—William E. Terrell

*Assistant Examiner*—Dean A. Reichard

*Attorney, Agent, or Firm*—Donald E. Hewson

[57] ABSTRACT

A height adjustable tanker access platform system having a fixed frame member, an access platform operatively mounted on the fixed frame member for vertical movement with respect to the fixed frame member, and a drive mechanism operatively engaged between the fixed frame member and the access platform so as to provide for raising and lowering of the access platform, is disclosed. The drive mechanism comprises a drive means securely mounted on a fixed frame member, a drive pulley operatively connected to the drive motor to permit selective driven rotation of the drive pulley about a first rotational axis, and a main idler pulley rotatably mounted on the access platform for rotation about a second rotational axis. A drive cable is securely attached at an anchored end to the fixed frame member and securely attached at an opposite remote end to a vertically moveable counterweight. The drive cable is looped around the main idler pulley and looped in driveable engagement around the drive pulley such that rotation of the drive pulley causes corresponding movement of the drive cable, so as to thereby cause the access platform to be vertically moved with respect to the fixed frame member. The drive pulley has a "V"-shaped groove disposed around the periphery thereof, with the "V"-shaped groove being angled and dimensioned so as to receive the drive cable in releasable binding relation therein.

14 Claims, 3 Drawing Sheets

TANKER ACCESS PLATFORM

FIELD OF THE INVENTION

This invention relates to tanker truck access platforms, railroad car access platforms, and more particularly to drive mechanisms for the same.

BACKGROUND OF THE INVENTION

Most tanker trucks and railroad tanker cars, which might contain any sort of liquid such as oil, chemicals, milk, water, and so on, typically have an access hatch at the top of the tank. Liquids are loaded into the tank through this access hatch by way of a large capacity discharge spout mounted on a raised tanker truck access platform structure, which is typically in the form of a large metal frame comprising a tanker access platform accessed by way of stairs. The access platform has an extension portion that extends outwardly therefrom so as to provide access to the access hatch at the top of the tanker truck. Further, access may be gained to the interior of the tank through this access hatch for purposes of cleaning, inspection, repair work, and so on.

In order to engage the loading spout into the access hatch, it is necessary that a person physically be at the access hatch on top of the tanker truck in order to open and close the access hatch and to manipulate and operate the discharge spout. Typically, a person, usually the truck driver, must climb up onto the tanker truck access platform structure by way of the stairs, and then onto the access platform. In early prior art access platform structures, a pivotally mounted end walkway of the access platform extended to the area of the tanker truck access hatch. The end walkway is pivotally moved between a raised position and a lowered position. In the raised position, the extension portion of the access platform would be out of the way of the tanker truck so as to preclude a tanker truck from potentially driving into the access platform. In the lowered position, the extension portion of the access platform would provide access to the access hatch on the top of the tanker truck. Typically, the access platforms on early prior art tanker truck access platform structures had a single set lowered position of a non-adjustable fixed height. Tanker trucks and railroad tank cars are of various heights, however, and vary in height by several feet. This variation of several feet in height of tanker trucks and railroad tank cars combined with the non-adjustable fixed height of access platforms can be quite dangerous. A person, such as a truck driver, may have to jump up or down, perhaps two or three feet, or even more, from the access platform to the tanker truck. This jumping up or down may be especially dangerous in winter weather conditions.

A more recently developed type of access platform system is one that has an access platform that remains level and moves vertically in a slidable sense to a selected height so as to be vertically aligned with the access hatch at the top of a tanker truck or railroad tank car. While this system works well in principle, there are specific problems associated with prior art tanker access platform systems employing this type of vertically slidable access platform. Typically, such vertically slidable access platforms are driven by hydraulics. The disadvantage of this type of system is that there is no "give" in the system—that is to say that the access platform does not yield to surrounding objects as it moves. It is a common occurrence to have a platform being lowered onto a tanker truck and to not stop at the appropriate height, but instead to forcibly contact the tanker truck, thus potentially causing damage to either the tanker truck or the access platform, which is obviously quite undesirable. While it is possible to employ limit switches or the like to stop the access platform at the appropriate height, this adds needless expense and complication to the tanker access platform system.

An improved type of tanker access platform system employs either belts or cables to raise and lower the access platform and is typically powered by either a hand operated wheel or a powered motor such as an electric motor. An advantage of a tanker access platform drive system that uses a belt or cable is that the belt or cable can "give" so as to preclude the access platform from forcibly lowering onto the tanker truck or tanker access platform. It is very important that in this type of access platform drive system that the cable, pulleys, and the moving platform itself, be aligned very accurately for various reasons, such as buckling of the drive belt or slipping of the cable on a pulley. It has been found, however, that misalignment, and therefor subsequent binding, of the access platform and of the drive mechanism in general can occur quite readily.

SUMMARY OF THE INVENTION

In accordance with one aspect of the present invention, there is provided a height adjustable tanker access platform system having a fixed frame member, an access platform operatively mounted on the fixed frame member for vertical movement with respect to the fixed frame member, and a drive mechanism operatively engaged between the fixed frame member and the access platform so as to provide means for raising and lowering the access platform. The drive mechanism comprises a drive means securely mounted on a selective one of the fixed frame member and the access platform, a drive pulley operatively connected to the drive motor to permit selective driven rotation of the drive pulley, a first rotational axis, and a main idler pulley rotatably mounted on the other of the fixed frame member and the access platform for rotation about a second rotational axis. A drive cable is securely attached at an anchored end to the fixed frame member and securely attached at an opposite remote end to a vertically moveable counterweight. The drive cable is looped around the main idler pulley and looped in driveable engagement around the drive pulley such that rotation of the drive pulley causes corresponding movement of the cable, so as to thereby cause the access platform to be vertically moved with respect to the fixed frame member. The drive pulley has a "V"-shaped groove disposed around the periphery thereof, with the "V"-shaped groove being angled and dimensioned so as to receive the drive cable in releasable binding relation therein.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
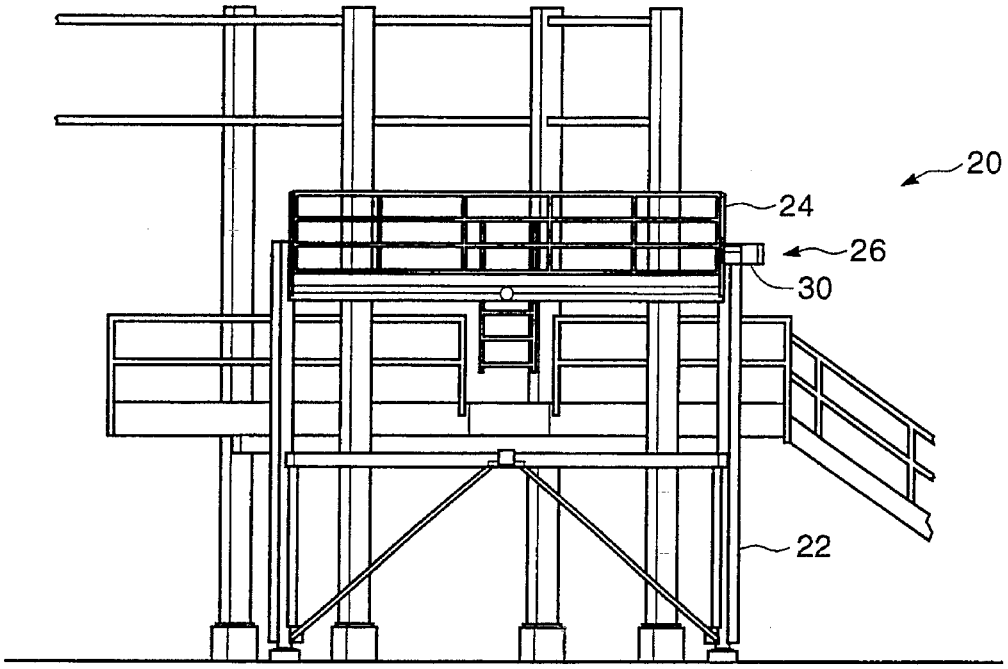
FIG. 1 is a front elevational view of a height adjustable tanker access platform system.

Reference will now be made to FIGS. 1 through 6, which show a height adjustable tanker access platform system, as indicated by the general reference numeral 20. The height adjustable tanker access platform system 20 has a fixed frame member 22, and an access platform 24 operatively mounted on the fixed frame member 22 for vertical movement with respect to the fixed frame member 22. The access platform 24 is a standard access platform known in the prior art and may be of any of a variety of shapes and sizes. Typically, the access platform 24 is extendable horizontally outwardly so as to reach a tanker truck parked thereat. A drive mechanism 26 comprising a drive means typically in the form of a drive motor 30, a drive pulley 40, a main idler pulley 50, and first and second drive cables 60 and 61 is operatively engaged between the fixed frame member 22 and the access platform 24 so as to provide means for raising and lowering the access platform 24. It should be noted that the drive means can also be a manually operable wheel or crank, or the like.

Figure 2:
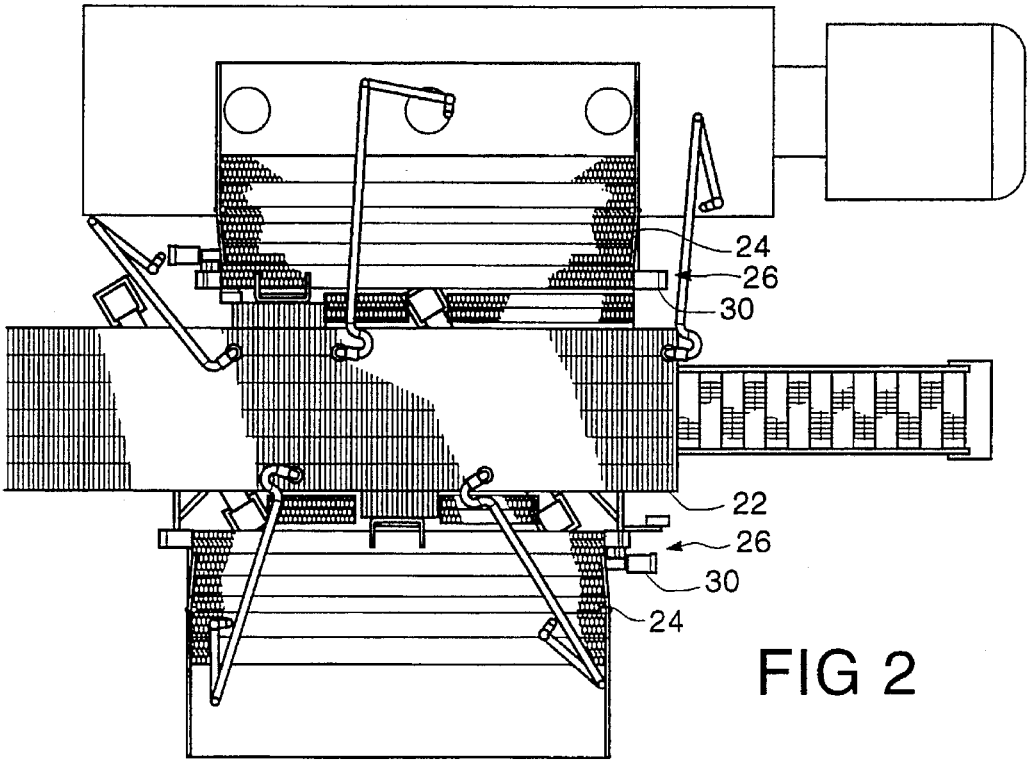
FIG. 2 is a top plan view of the height adjustable tanker access platform system of FIG. 1.
Figure 3:
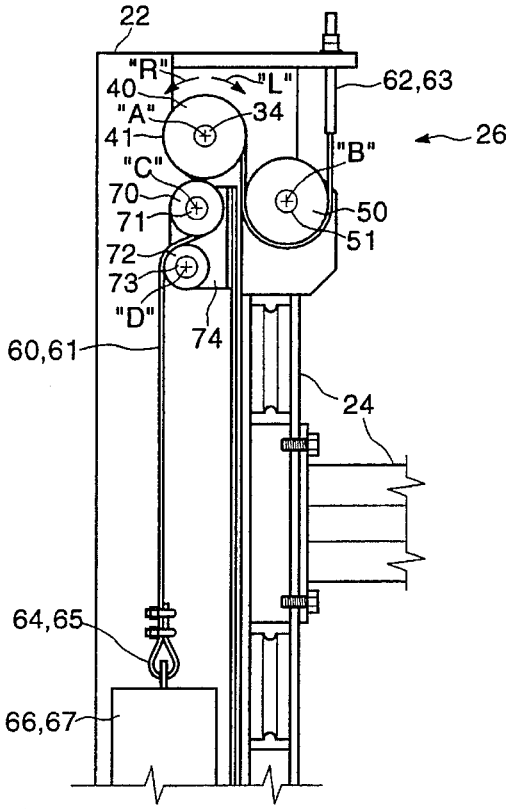
FIG. 3 is an enlarged rear elevational view of a portion of FIG. 1, specifically showing the drive mechanism.

In FIGS. 1 and 2, two access platforms 24 are shown; however, as both access platforms 24 are essentially identical, reference will be made to only one of the two access platforms 24, for ease of reference. A separate drive mechanism 26 is required for each access platform 24.

Figure 4:
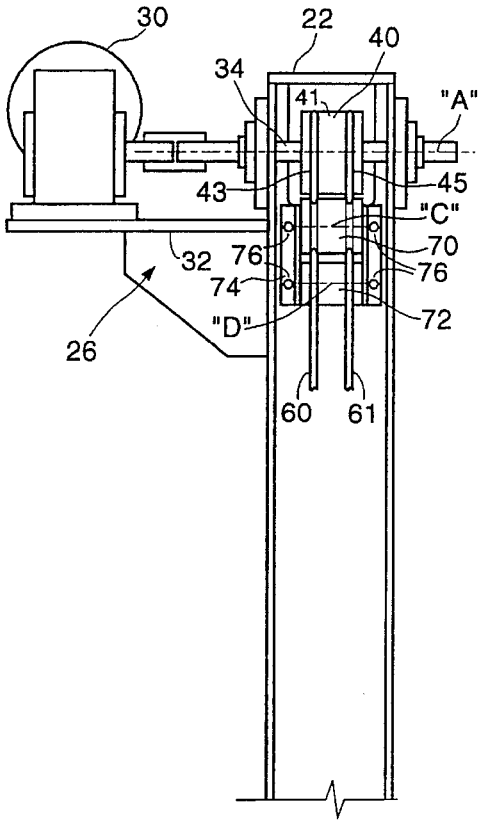
FIG. 4 is a side elevational view of the drive mechanism of the height adjustable tanker access platform system, as shown in FIG. 3.
Figure 5:
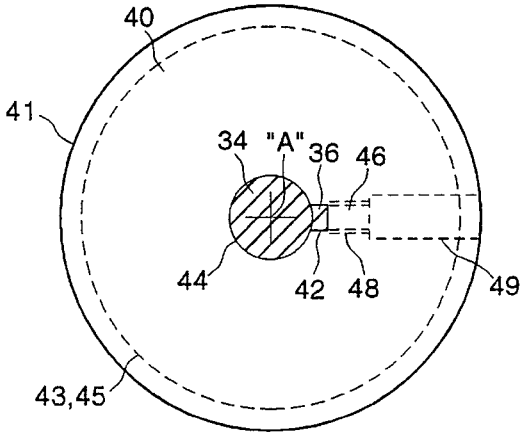
FIG. 5 is a greatly enlarged side view of the drive pulley of the drive mechanism.
Figure 6:
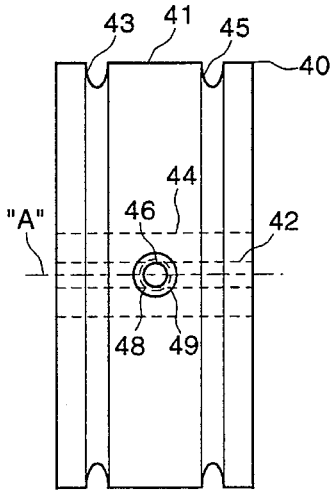
FIG. 6 is a from elevational view of the drive pulley of FIG. 5.

The drive motor 30 is securely mounted to the fixed frame member 22, as best seen in FIG. 4, by way of a support bracket member 32 that is either welded or bolted to the fixed frame. The drive motor 30 is preferably an electric motor for ease of installation and operation, but may be any suitable type of motor means, such as a hydraulic motor, pneumatic motor, and so on. The drive motor 30 may also be securely mounted on the access platform 24, if desired; however, it is not preferable to mount the drive motor 30 on the access platform 24 as this may tend to cause problems with wires and the like that would need to extend between the fixed frame member 22 the moveable access platform 24.

A drive pulley 40 is securely connected to the drive shaft 34 of the drive motor 30 to permit selective driven rotation of the drive :pulley 40 about a first rotational axis "A". The first rotational axis "A" is preferably substantially horizontally disposed so as to properly receive a cable or the like therearound, as will be discussed subsequently, but may be oriented at any angle that is desired, if appropriate. The drive shaft 34 has a key 36 that co-operatively engages a keyway 42 in the central aperture 44 of the drive pulley 40, for positive driving engagement of the drive pulley 40 by the drive shaft 34 in either rotational direction. The drive pulley 40 is secured to the drive shaft 34 by way of a threaded fastener member 46, such as an Allen key, threadibly engaged in a threaded aperture 48. The threaded fastener member 46 is accessed for tightening and loosening by way of an enlarged bore hole 49 that opens to the periphery 41 of the drive pulley 40. The diameter of the drive pulley 40 must be chosen to work properly in conjunction with the drive motor 30, of known power, in order to be able to lift the weight of the access platform 24, and may be determined through routine design calculation. The drive pulley 40 has a first "V"-shaped groove 43 disposed around the periphery 41 thereof as will be discussed in greater detail subsequently.

A main idler pulley 50 is freely rotatably mounted on the other of the fixed frame member 22 and the access platform 24—in the preferred embodiment, it is mounted on the access platform 24—by way of a suitable mounting pin 51. The main idler pulley 50 is mounted for rotation about a second rotational axis "B", which is preferably also substantially horizontal. Further, in the preferred embodiment, the first rotational axis "A" and the second rotational axis "B" are parallel one to the other for the sake of convenience of design and ease of operation.

A first drive cable 60 is securely attached at an anchored end 62 to the fixed frame member 22, preferably near the top of the fixed frame member 22 above the access platform 24. The first drive cable 60 is securely attached at its opposite remote end 64 to a vertically moveable counterweight 66, which counterweight 66 counteracts the weight of the access platform 24. Preferably, there is also a second matching counterweight (not shown) at the opposite other end of the fixed frame member 22, which second counterweight is securely attached to the access platform 24 by way of a cable looped around a second matching idler pulley on the access platform 24, so as to balance the counterweight 66. Together the two counterweights weigh approximately one-half of the weight of the access platform 24, and thus offset the weight of the access platform 24, as will be readily apparent to one skilled in the art.

The first drive cable 60 is looped in driveable engagement around the drive pulley 40, within the "V"-shaped groove 43 . This first is angled and dimensioned so as to receive the first drive cable 60 in releasable binding relation therein. Preferably, the first "V"-shaped groove 43 forms an angle of between about 20° and about 90°, with the most preferred angle being about 55°. The "V"-shaped groove may be of the appropriate depth necessary in order to accommodate the diameter of the cable. The angle of the "V"-shaped groove is usually not altered to accommodate, the diameter of the cable. The exact shape of the groove is not critical. What is critical is that the two sides **43*a* and 43*b* of the "V"-shaped groove 43 slope with respect with to each other so as to receive the drive cable 60 in wedging engagement therebetween. It is important that the drive cable 60 does not contact the drive pulley 40 against a surface that generally faces the perimeter of the drive pulley 40, or at least have very minimal contact with such a surface. Contact of the drive pulley 40 with such a surface would generally preclude the wedging engagement of the drive cable 60 with the two opposed sides 43*a* and 43*b* of the "V"-shaped groove 43, thus precluding the first drive cable 60 from being in releasable binding engagement with the drive pulley 40, which in turn would preclude the drive pulley 40 from transmitting substantial drive forces to the drive cable 60**.

The binding engagement of the first drive cable 60 in the "V"-shaped groove 43 of the drive pulley 40 permits corresponding movement of the first drive cable 60 upon rotation of the drive pulley 40 in either rotational direction, as indicated by arrows "R" and "L", corresponding to raising and lowering, respectively, of the access platform 24.

The first drive cable 60 is also looped around the main idler pulley 50 on the access platform 24. In this manner, when the drive pulley 40 is rotated so as to correspondingly move the first drive cable 60, the access platform 24 is caused to be vertically moved with respect to the fixed frame member 22.

In the preferred embodiment, the drive mechanism 26 further comprises a second drive cable 61, securely attached at an anchored end 63 to the fixed frame member 22 at virtually the same location as the first drive cable 60 is attached to the fixed frame member 22. There is also a second "V"-shaped groove 45 disposed around the periphery 41 of the drive pulley 40, which second "V"-shaped groove 45 is also angled and dimensioned so as to receive the second drive cable 61 in releasable binding relation therein. The second drive cable 61 is also looped around the main idler pulley 50 and looped in driveable engagement around the drive pulley 40 in an equivalent manner to the first drive cable 60. The second drive cable 61 is included for two reasons. Firstly, it provides redundancy in the event of failure of one drive cable 60 or 61, as required by statutory safety codes in many areas; secondly, the driving force from the rotating drive pulley is divided between the two drive cables 60 and 61, thus permitting the drive cables to be of a reduced diameter compared to a single drive cable; and thirdly, the area of contact between the "V"-shaped grooves 43 and 45 and the respective drive cables 60 and 61 is increased. There is a maximum amount of force that can be transmitted from the drive pulley 40 to each of the drive cables 60 and 61, and there is a preferred maximum size of drive cable as larger diameter cables are more difficult to work with and would require a larger "V"-shaped groove 45 in the drive pulley 40. It is generally preferable in most instances, for various reasons, to have standard diameter drive cables and standard depth grooves in the drive pulley.

Preferably, both drive cables 60 and 61 are secured at their respective opposite remote ends 64 to a single counterweight 66. The use of a single counterweight for each drive cable is less safe in the event of a cable breaking.

In order to further increase the area of contact between each of the drive cables 60 and 61 and the drive pulley 40, irrespective of whether there are one, two, or more drive cables, a first auxiliary pulley 70 is rotatably mounted on a mounting bracket member 74 by way of a suitable mounting pin 71 for rotation about a third rotational axis "C". The mounting bracket member 74 is secured to the fixed frame member 22 by way of bolts 76. The first auxiliary pulley 70 is located with respect to the main idler pulley 50 such that when the first drive cable 60 and the second drive cable 61 are looped around the main idler pulley 50, the drive pulley 40, and the first auxiliary pulley 70, the first and second drive cables 60 and 61 are looped around approximately 270° of the drive pulley 40. Further, in order to increase the area of contact between the first and second drive cables 60 and 61, and the first auxiliary pulley 70, irrespective of whether there is one, two, or more drive cables, there is also included a second auxiliary pulley 72 rotatably mounted on the mounting bracket member 74 by way of a suitable mounting pin 73, for rotation about a fourth rotational axis "D". The second auxiliary pulley 72 is located with respect to the first auxiliary pulley 70 such that the first and second drive cables 60 and 61 are looped around approximately 180° of the first auxiliary pulley 70.

In operation, when the drive motor 30 rotates the drive pulley 40, the drive pulley 40 causes corresponding movement of the first and second drive cables 60 and 61, so as to thereby cause the first and second drive cables 60 and 61 to be pulled around the main idler pulley 50 on the access platform 24, thus causing the access platform 24 to be vertically moved with respect to the fixed frame member 22. The first and second drive cables 60 and 61 bind within the respective first and second "V"-shaped grooves 43 and 45 so as to maximize the amount of friction therebetween, and thereby to maximize the amount of force that can be transmitted from the drive pulley 40 to each of the first and second drive cables 60 and 61. Thus, any potential tendency for the first and second drive cables 60 and 61 to slip with respect to the drive pulley 40, is minimized.

Under extreme loads, however, such as would be encountered if the access platform 24 becomes stuck, the first and second drive cables 60 and 61 can release from their respective first and second "V"-shaped grooves 43 and 45 in the drive pulley 40. In this manner, the drive mechanism 26 of the present invention also acts as a clutch mechanism, while also providing a high degree of binding engagement between the drive pulley 40 and the first and second drive cables 60 and 61.

Figure 7:
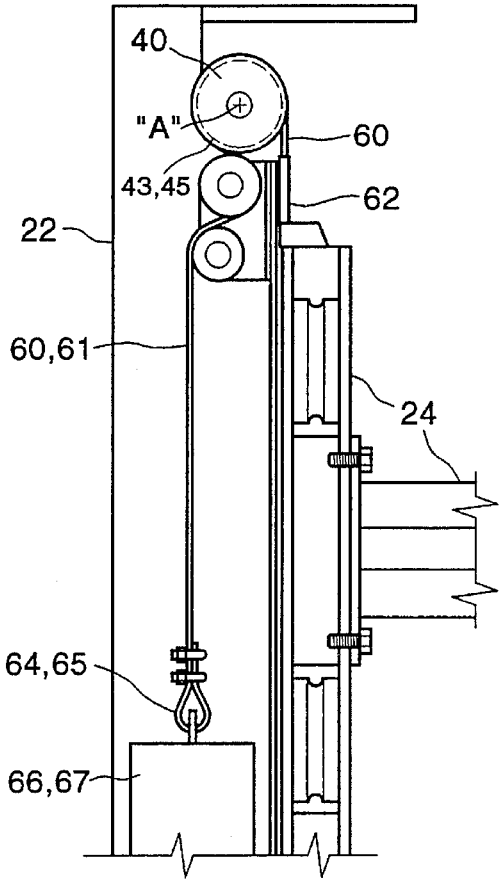
FIG. 7 is an enlarged rear elevational view similar to FIG. 3, but of an alternative embodiment of the present invention.

In an alternative embodiment of the present invention, as shown in FIG. 7, it is envisioned that the drive motor 30 (not shown in FIG. 7) would be securely mounted to the fixed frame member 22, that there would be a drive pulley 40 operatively connected to the drive motor 30 to permit selective driven rotation of the drive pulley 40 about a first rotational axis "A", and that there would be no main idler pulley. A first drive cable 60 would be securely attached at an anchored end 62 to the access platform 24 and securely attached at an opposite remote end to a vertically moveable, counterweight 66. The first drive cable 60 would be in driveable engagement around the drive pulley 40 such that rotation of the drive pulley 40 would cause corresponding movement of the first drive cable 60, so as to thereby cause the access platform 24 to be vertically moved with respect to the fixed frame member 22. As in the preferred embodiment, the drive pulley 40 would have "V"-shaped grooves 43 and 45 disposed around the periphery thereof, with the first and second "V"-shaped grooves 43 and 45 being angled and dimensioned so as to receive the first and second drive cables 60 and 61, respectively, in releasable binding relation therein.

Figure 8:
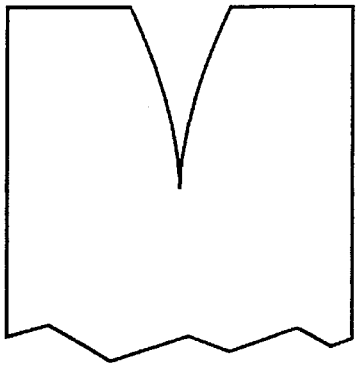
FIG. 8 is a greatly enlarged partial end view of an alternative embodiment of the "V"-shaped groove in the drive pulley.
Figure 9:
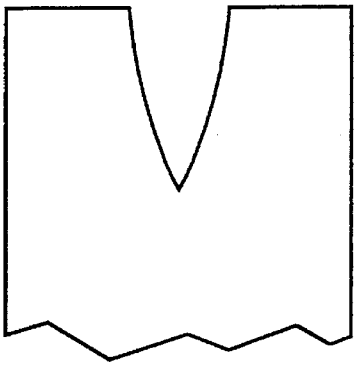
FIG. 9 is a greatly enlarged partial end view of another alternative embodiment of the "V"-shaped groove in the drive pulley.
Figure 10:
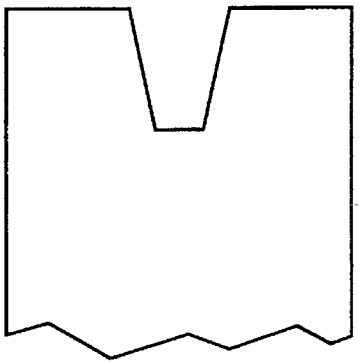
FIG. 10 is a greatly enlarged partial end view of yet another alternative embodiment of the "V"-shaped groove in the drive pulley.

Alternate embodiments of the "V"-shaped groove, are shown in FIG. 8, 9, and 10. Each of these "V"-shaped grooves has sloped sides to receive a drive cable in wedged engagement between the sloped sides so as to permit the drive cable to be looped in drivable engagement around the drive pulley.

Other modifications and alterations may be used in the design and manufacture of the apparatus of the present invention without departing from the spirit and scope of the accompanying claims.

What is claimed is:

1. A height adjustable tanker access platform system having a fixed frame member, an access platform operatively mounted on said fixed frame member for vertical movement with respect to said fixed frame member, and a drive mechanism operatively engaged between said fixed frame member and said access platform so as to provide means for raising and lowering said access platform, said drive mechanism comprising:

a drive means securely mounted on a selected one of said fixed frame member and said access platform;

a drive pulley operatively connected to said drive means to permit selective driven rotation of said drive pulley about a first rotational axis;

a main idler pulley rotatably mounted on the other of said fixed frame member and said access platform for rotation about a second rotational axis; and a first drive cable securely attached at an anchored end to said fixed frame member and securely attached at an opposite remote end to a vertically movable counter-weight, said first drive cable being looped around said main idler pulley and looped in drivable engagement around said drive pulley such that rotation of said drive pulley causes corresponding movement of said first drive cable, so as to thereby cause said access platform to be vertically moved with respect to said fixed frame member;

wherein said drive pulley has a first "V"-shaped groove disposed around the periphery thereof, wherein said first "V"-shaped groove forms an angle of between about 40° and about 70° so as to receive said first drive cable in releasable binding relation therein.

2. The height adjustable tanker access platform system of claim 1, wherein said drive means is mounted on said fixed frame member and said idler pulley is rotatably mounted on said access platform.

3. The height adjustable tanker access platform system of claim 2, wherein said first rotational axis and said second rotational axis are substantially parallel.

4. The height adjustable tanker access platform system of claim 3, wherein said first rotational axis and said second rotational axis are substantially horizontally disposed.

5. The height adjustable tanker access platform system of claim 1, wherein said drive mechanism further comprises a second drive cable and wherein said drive pulley also has a second "V"-shaped groove disposed around the periphery thereof, with said second "V"-shaped groove being angled and dimensioned so as to receive said second drive cable in releasable binding relation therein.

6. The height adjustable tanker access platform system of claim 2, further comprising a first auxiliary pulley rotatably mounted on said fixed frame member for rotation about a third rotational axis, said first auxiliary pulley being located with respect to said drive pulley such that said first drive cable is looped around about 270° of said drive pulley.

7. The height adjustable tanker access platform system of claim 6, further comprising a second auxiliary pulley rotatably mounted on said fixed frame member for rotation about a fourth rotational axis, said second auxiliary pulley being located with respect to said first auxiliary pulley such that said first drive cable is looped around about 180° of said first auxiliary pulley.

8. The height adjustable tanker access platform system of claim 1, wherein said first "V"-shaped groove forms an angle of about 55°.

9. A height adjustable tanker access platform system having a fixed frame member, an access platform operatively mounted on said fixed frame member for vertical movement with respect to said fixed frame member, and a drive mechanism operatively engaged between said fixed frame member and said access platform so as to provide means for raising and lowering said access platform, said drive mechanism comprising:

a drive means securely mounted on said fixed frame member;

a drive pulley operatively connected to said drive means to permit selective driven rotation of said drive pulley about a first rotational axis;

a first drive cable securely attached at an anchored end to said access platform and securely attached at-an opposite remote end to a vertically movable counter-weight, said first drive cable being in drivable engagement around said drive pulley such that rotation of said drive pulley causes corresponding movement of said first drive cable, so as to thereby cause said access platform to be vertically moved with respect to said fixed frame member;

wherein said drive pulley has a first "V"-shaped groove disposed around the periphery thereof, wherein said first "V"-shaped groove forms an angle of between about 40° and about 70° so as to receive said first drive cable in releasable binding relation therein.

10. The height adjustable tanker access platform system of claim 9, wherein said first rotational axis is substantially horizontally disposed.

11. The height adjustable tanker access platform system of claim 10, wherein said drive mechanism further comprises a second drive cable and wherein said drive pulley also has a second "V"-shaped groove disposed around the periphery thereof, with said second "V"-shaped groove being angled and dimensioned so as to receive said second drive cable in releasable binding relation therein.

12. The height adjustable tanker access platform system of claim 9, further comprising a first auxiliary pulley rotatably mounted on said fixed frame member for rotation about a second rotational axis, said first auxiliary pulley being located with respect to said drive pulley such that said first drive cable is looped around about 270° of said drive pulley.

13. The height adjustable tanker access platform system of claim 12, further comprising a second auxiliary pulley rotatably mounted on said fixed frame member for rotation about a fourth rotational axis, said second auxiliary pulley being located with respect to said first auxiliary pulley such that said first drive cable is looped around about 180° of said first auxiliary pulley.

14. The height adjustable tanker access platform system of claim 9, wherein said first "V"-shaped groove forms an angle of about 55°.

* * * * *